US007472878B2

(12) United States Patent
Schwoerer

(10) Patent No.: US 7,472,878 B2
(45) Date of Patent: Jan. 6, 2009

(54) LOWERING DEVICE COMPRISING A SUPPORT STRUCTURE

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 250 days.

(21) Appl. No.: 10/576,524

(22) PCT Filed: Nov. 3, 2004

(86) PCT No.: PCT/DE2004/002427

§ 371 (c)(1),
(2), (4) Date: Apr. 20, 2006

(87) PCT Pub. No.: WO2005/045159

PCT Pub. Date: May 19, 2005

(65) Prior Publication Data

US 2007/0170319 A1 Jul. 26, 2007

(30) Foreign Application Priority Data

Nov. 3, 2003 (DE) ..... 103 51 255

(51) Int. Cl.
*E04G 25/00* (2006.01)
*E04G 17/00* (2006.01)

(52) U.S. Cl. ..... 248/351; 248/246; 248/295.11; 248/354.1; 249/219.1

(58) Field of Classification Search ..... 248/351, 248/200.1, 201, 235, 241, 243, 244, 295.11, 248/297.31, 221.11, 222.13; 249/219.1
See application file for complete search history.

(56) References Cited

U.S. PATENT DOCUMENTS

| | | | | | |
|---|---|---|---|---|---|
| 3,843,084 | A | * | 10/1974 | Gregory et al. | 248/295.11 |
| 3,863,878 | A | * | 2/1975 | Gregory et al. | 248/295.11 |
| 4,103,856 | A | * | 8/1978 | Riblet | 248/246 |
| 4,467,993 | A | | 8/1984 | Markewitz | |

FOREIGN PATENT DOCUMENTS

| | | | | |
|---|---|---|---|---|
| DE | 10056831 | A | * | 2/2002 |
| EP | 0092694 | A2 | * | 11/1983 |
| EP | 0 283 391 | | | 9/1988 |
| FR | 2414599 | A | * | 9/1979 |
| GB | 2099902 | A | * | 12/1982 |
| GB | 2 344 609 | | | 6/2000 |

* cited by examiner

*Primary Examiner*—Anita M King
(74) *Attorney, Agent, or Firm*—Paul Vincent

(57) ABSTRACT

The invention relates to a lowering device (10) for the construction industry, which comprises a support structure. The lowering device comprises a plate (17) holding a locking mechanism (16) and blocking or releasing the mobility of bolts (12, 13). The bolts (12, 13) are firmly linked with a support structure and are fastened on the locking mechanism (16) in a controlled manner to such an extent that, in a first position, the support structure linked with the lowering device (10) is lifted and, in a second position of the locking mechanism, the support structure linked therewith is lowered as much as the locking mechanism permits.

6 Claims, 6 Drawing Sheets

LOWERING DEVICE COMPRISING A SUPPORT STRUCTURE

This application is the national stage of PCT/DE2004/00427 filed on Nov. 3, 2004 and claims Paris Convention priority of DE 103 51 255.1 filed Nov. 3, 2003.

The invention concerns a lowering device for a support structure for safely lowering all building industry loads.

Support structures for the building industry, such as ceiling formwork elements or floor tables are conventionally held by construction supports with adjustable length, which are adjusted to a predetermined length for a concrete pouring process. For example, a large number of construction supports, e.g. floor tables, are used for concrete pouring of large ceiling sections. When the ceiling to be poured with concrete has hardened to a sufficient degree, the formwork must be removed from the ceiling by shortening e.g. all telescopic construction supports which support the ceiling formwork until the formwork elements or floor tables can be removed and re-used at another location.

The removal of the formwork may be complicated when a plurality of construction supports are used to support heavy loads. Each construction support must be individually shortened, e.g. via a spindle procedure.

It is the object of the invention to provide a lowering device which can be moved in a safe, simple and rapid manner into a first working position and a second lowered position.

SUMMARY OF THE INVENTION

This object is achieved in accordance with the invention by a lowering device of a support structure, consisting of at least one plate, wherein a locking mechanism is formed on a first side of the plate, which can be moved into two positions, and wherein a support structure can be disposed at a second side of the plate, lifted relative to the stationary plate in a first position of the locking mechanism, and lowered relative to the stationary plate in a second position of the locking mechanism in response to the force of gravity, wherein the support structure engages the locking mechanism via at least one bolt, the bolt being displaceable relative to the plate from the first position into the second position and vice versa.

The inventive lowering device offers the essential advantage that a support structure can be adjusted to a required height by opening a locking mechanism which is stable under load and which automatically repositions itself, such that a support structure connected to the lowering device is immediately lowered by the desired amount. The lever ratios of the locking mechanism may thereby be selected such that even heavy loads of between e.g. 5 and 10 t can be lowered in a fast and safe manner by one worker using only little force. In its first position, the locking mechanism is self-locking under load, such that inadvertent opening of the inventive locking mechanism is not possible.

The inventive locking mechanism is preferably formed by one first and one second latch part which each surround at least part of a bolt at a first free end region thereof, wherein the bolts extend through elongated holes in the plate to permit displacement thereof relative to the plate, and the bolts can be fixed to the support structure in the region of their second free ends.

Safe lowering can thereby be advantageously ensured with a very simple structure.

In a further embodiment of the inventive locking mechanism, the second latch part is disposed for rotation around the bolt which it surrounds, and comprises a first and a second support surface via which the second latch part is supported on a projection of the plate in correspondence with its respective position, wherein the respective support surfaces have different separations from the axis of rotation formed by the bolt.

When the plate is stationary, this structure permits safe lowering of the support structure connected to the lowering device in dependence on the design of the two support surfaces of the second latch part and their separation from the axis of rotation of the second latch part. Lowering is possible only to the extent allowed by the matching support surfaces on the second latch part.

The first latch part advantageously comprises a first free end which partially covers an opening of the plate and surrounds the bolt in such a manner that, upon pivoting of the first latch part away from the opening, the second latch part automatically pivots into the second position under the action of the force exerted by the support structure onto the locking mechanism.

This is advantageous in that the locking mechanism can be triggered, i.e. be opened with only little force using an aid, e.g. a rod that can be inserted into the opening. The latch parts formed in the locking mechanism are pivoted and turned into a second end position, which limits the lowering motion of a support structure connected to the lowering device.

The inventive lowering device is further improved by mounting the plate to one end of a longitudinal housing having a bracket at the other end that has an elongated hole for receiving a bolt which can be connected to the support structure in a stationary manner, the bracket being overlapped by a frame which is rigidly connected to both the bracket and the plate.

This embodiment of the inventive lowering device permits connection of a conventional construction support to the lowering device in a torsion-proof and bending-resistant fashion. If the lowering device is mounted to a construction support in this fashion, the support structure connected to the lowering device can be lowered rapidly and safely by an amount predetermined by the locking mechanism.

The frame advantageously forms a housing which receives both the bracket and the plate, and comprises receptacles for a support for immovably connecting the lowering device to the support. A construction support can be quickly and safely mounted to the lowering device via such receptacles.

Lowering devices of this type are preferably mounted to the sides of truss girders of a floor table. If a floor table is held by numerous construction supports, each having an inventive lowering device, the floor table can be quickly and safely lowered and be re-used when the concrete pouring process is completed.

Further advantages can be extracted from the description of the attached drawings. The features of the invention mentioned above and below can be used individually or in arbitrary combination. The above-mentioned embodiments are not to be understood as exhaustive enumeration but have exemplary character.

The invention is described in more detail below with reference to an embodiment. The lowering devices or parts thereof shown in the figures are not necessarily true to scale.

DESCRIPTION OF THE PREFERRED EMBODIMENT

Figure 1:
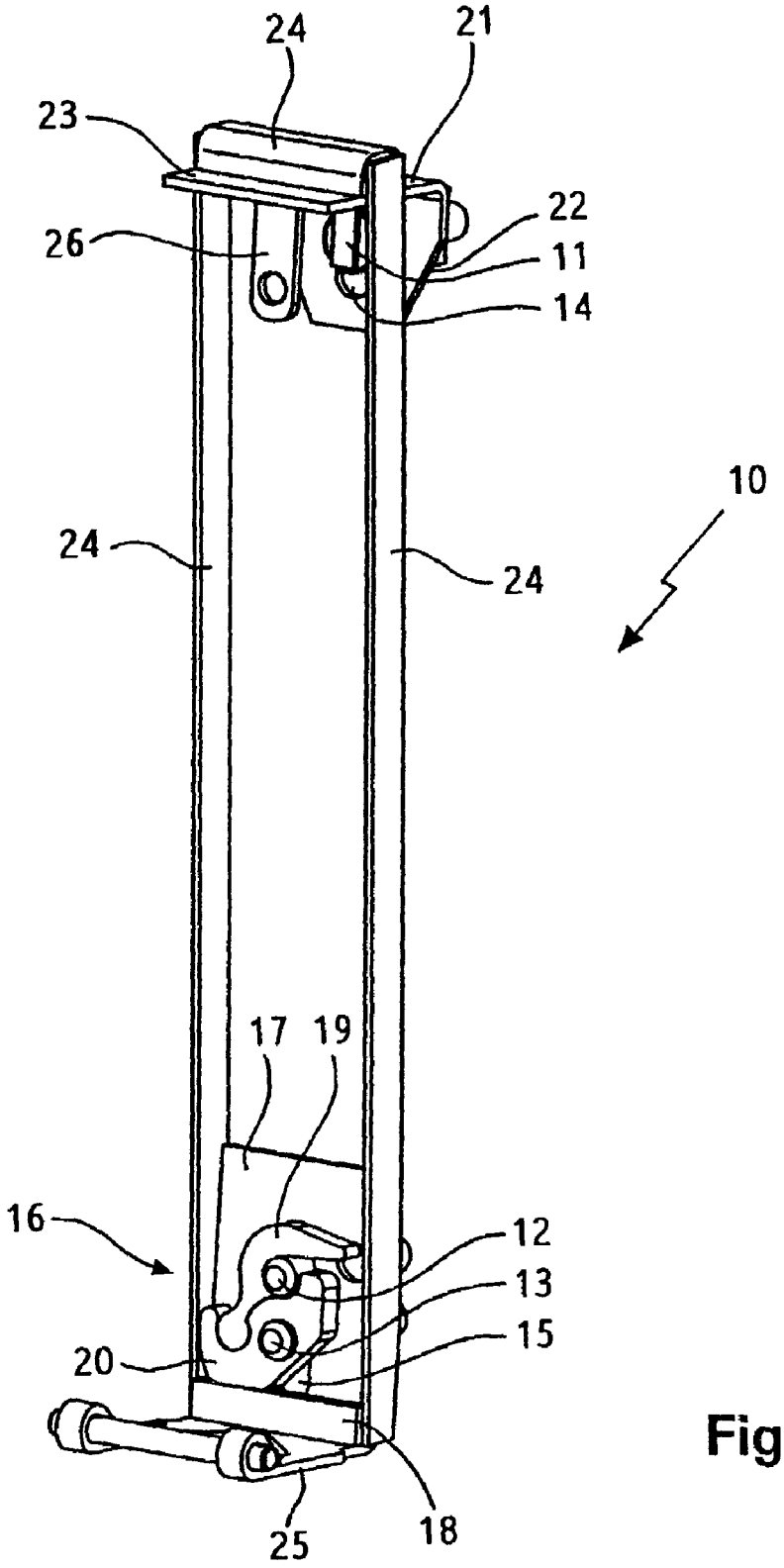
FIG. 1 shows an inventive lowering device which can be mounted e.g. to a support structure and to a construction support.

FIG. 1 shows a lowering device 10 which can be mounted to a construction support (not shown) and to a support structure (also not shown in the figure). The lowering device 10 is connected to a support structure via bolts 11, 12, 13. The sections of the bolts 11, 12, 13 facing away from the support structure penetrate through a first elongated hole 14 and a second elongated hole 15 of the lowering device 10. The bolts 11, 12, 13 and the support structure connected thereto can be displaced along the elongated holes 14, 15 when a locking mechanism 16 of the lowering device 10 is opened.

The locking mechanism 16 comprises a plate 17 with a projection or stop 18, a first latch part 19, a second latch part 20 and the bolts 12, 13. The first and second latch parts 19, 20 can be pivoted or turned about the bolts 12, 13. The second latch part 20 is supported on the projection 18 both in a first and in a second location of the locking mechanism 16. FIG. 1 shows the locking mechanism 16 in its closed position, i.e. a support structure connected to the bolts 11, 12, 13 is in the lifted position.

The bolt 11 is displaceably held in a bracket 21 which also contains the elongated hole 14. The bracket 21, which is bent in an L-shape, abuts the support structure to be retained, via a first leg piece 22. A frame portion 24 is preferably connected to a second leg piece 23 of the bracket 21 with material fit. The frame 24 with bracket 21 and plate 17 and the individual parts mounted thereto, form a housing extending in a longitudinal direction, which also has a first and a second receptacle 25, 26 for guiding and fixing a construction support and which can preferably be adjusted in height.

The first receptacle 25 engages with a construction support held in this receptacle 25 in a positive fashion, and the second receptacle 26 is designed as finger that engages in the free end of a construction support. A construction support retained in the lowering device 10 can be securely connected to the lowering device 10, e.g. via a bolt, through the opening formed on the finger.

The lowering device 10 of the figure is preferably a metal construction which can accept the load or a partial load of a support structure connected to the lowering device 10.

Figure 2C:
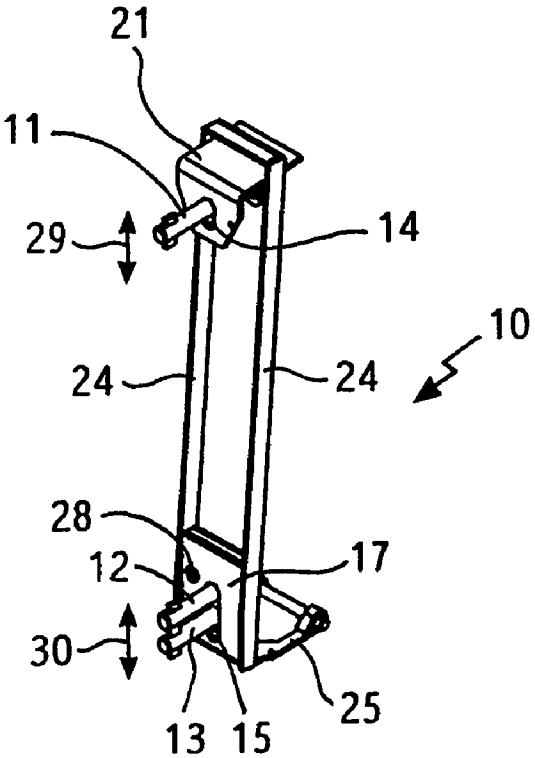
FIGS. 2*a* through 2*c* show different views of the inventive lowering device of FIG. 1.
Figure 2B:
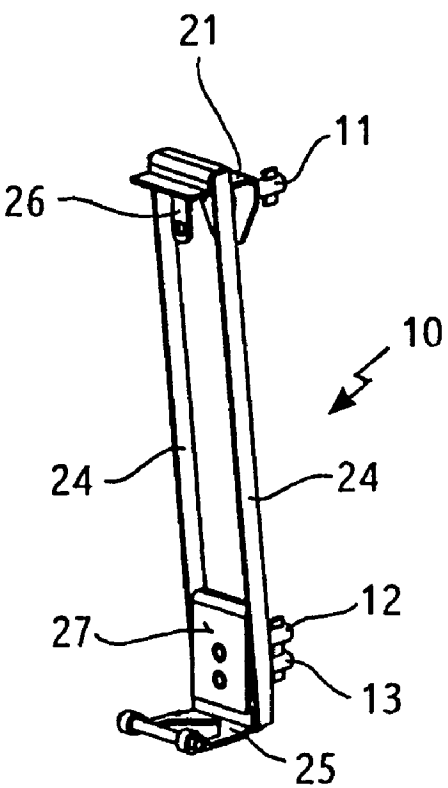
Figure 2A:
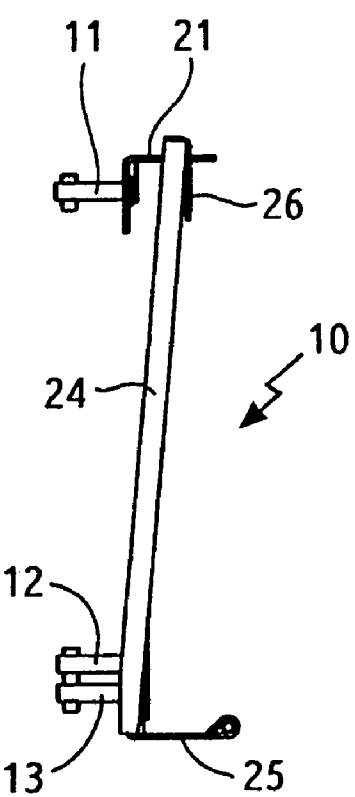

FIGS. 2*a*, 2*b* and 2*c* show different views of the lowering device 10. FIG. 2*a* shows a side view of the lowering device 10 and the positions of the bolts 11, 12, and 13. The bolt 11 is disposed in the bracket 21 such that it can be displaced, and the bracket 21 also holds the receptacle 26 for fixing a construction support in the lowering device 10. The bracket 21 is connected to the plate 17 holding the bolts 12, 13 via the frame 24. The lower end of the frame 24 comprises the first receptacle 25.

FIG. 2*b* shows the lowering device 10 in a positioned turned relative to FIG. 2*a* such that the position and design of the bolts 11, 12, 13 and the design of the receptacles 25, 26 on the bracket 21 and on the lower end of the frame 24 are clearly shown. The locking mechanism formed in the lowering device 10 is covered by a cover plate 27 which protects the moved parts of the locking mechanism from being soiled and damaged.

FIG. 2*c* shows the lowering device 10 from a point of view which clearly shows the bearing of the bolt 11 in the bracket 21 and the bearing of the bolts 12, 13 in the plate 17. The receptacle 25 and the bracket 21 project beyond the frame 24. The bolts 11, 12, 13 are displaceably disposed in the elongated holes 14, 15. The plate 17 has an opening 28 via which the locking mechanism formed on the other side of the plate 17 can be actuated. In a state of the lowering device 10 mounted to a support structure, the opening 28 must be accessible for the staff operating the lowering device 10. The bolt 11 can be displaced in the elongated hole 14 in the direction of arrows 29 and the bolts 12, 13 can be displaced in the elongated hole 15 in the direction of arrows 30. When a support structure is mounted to the bolts 11, 12, 13, the bolts 11, 12, 13 can be displaced in the direction of arrows 29, 30 with the lowering device being stationary.

Figure 3:
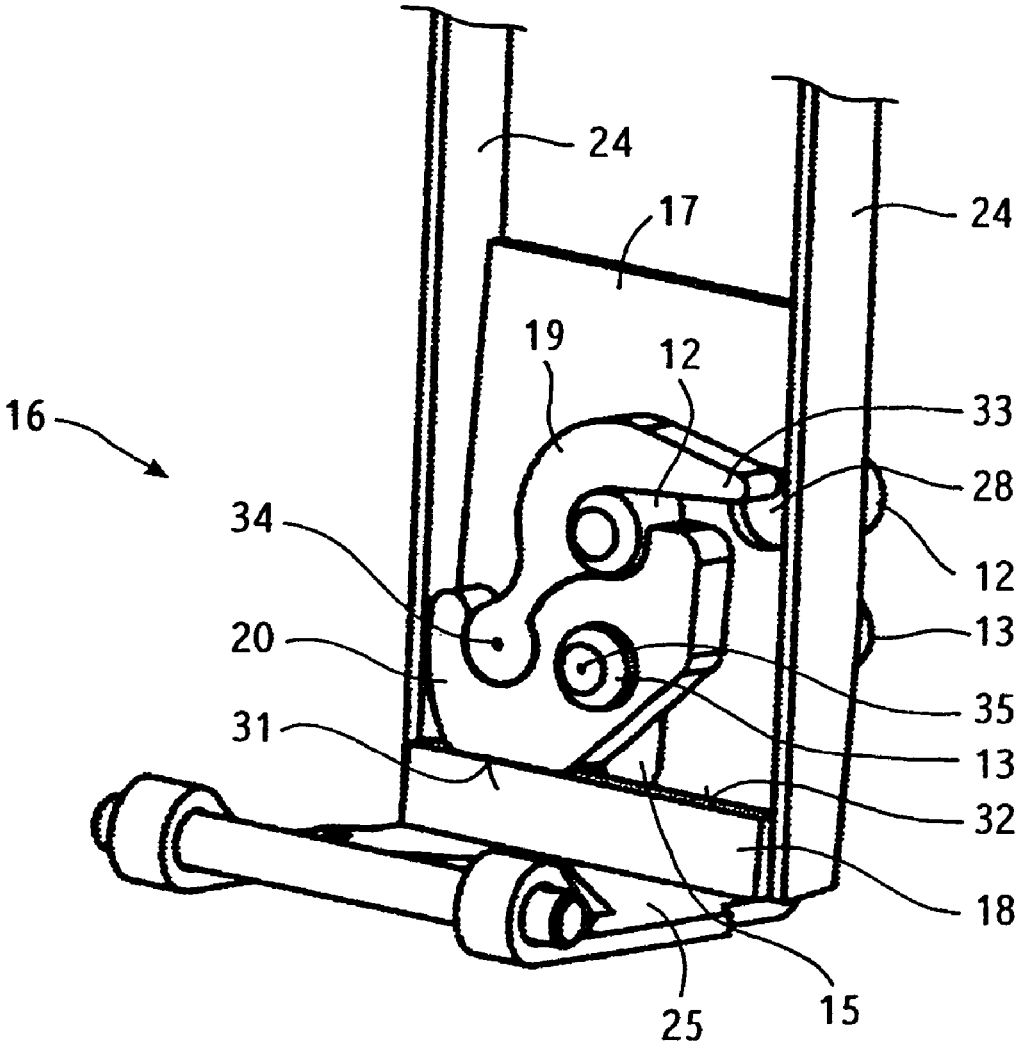
FIG. 3 shows a detail of an inventive lowering device comprising a locking mechanism formed in the lower part of the lowering device and located in a first position.

FIG. 3 shows a detail of the frame 24 with plate 17 mounted thereto, which receives the locking mechanism 16. The first receptacle 25 projects beyond the plate 17 and the projection 18 which supports the second latch part 20 via a first support surface 31 lies in front of the plane formed by the plate 17. The support surface 31 is supported on a stop surface 32 of the projection 18. The first and second latch parts 19, 20 are designed and matched to each other such that the locking mechanism 16 is safely and immovably held in its self-locking position shown in the figure even when the lowering device 10 is subjected to heavy loads by a support structure. When the bolts 12, 13 are each rigidly connected to a support structure, and the locking mechanism 16 is stationarily mounted to a construction support, the locking mechanism 16 retains the support structure, fastened via the bolts 12, 13, in a lifted first position. A vertical load acting directly on the bolts 12, 13 cannot change the position of the locking mechanism 16. In the first location of the locking mechanism 16, a free end 33 of the first latch part 19 partially covers the opening 28 formed on the plate 17. If the closed locking mechanism 16 shown in FIG. 3 is opened by a force acting on the free end 33 of the first latch part 19, by introducing a force in an anticlockwise direction onto the free end 33, the first and the second latch part 19, 20 move. The first latch part 19 can be turned about an axis of rotation 34 and the second latch part 20 is disposed to be rotatable about an axis 35 of the bolt 13. If the first latch part 19 is loaded about the axis of rotation 34 in an anticlockwise direction via the first free end 33, the first latch part 19 pivots away from the bolt 12 and the second latch part 20 simultaneously turns about the axis 35 of the bolt 13 in a clockwise direction. As the second latch part 20 turns in a clockwise direction, the bolts 12, 13 move from a raised position (FIG. 3) into a lower position within the elongated hole 15.

Figure 4:
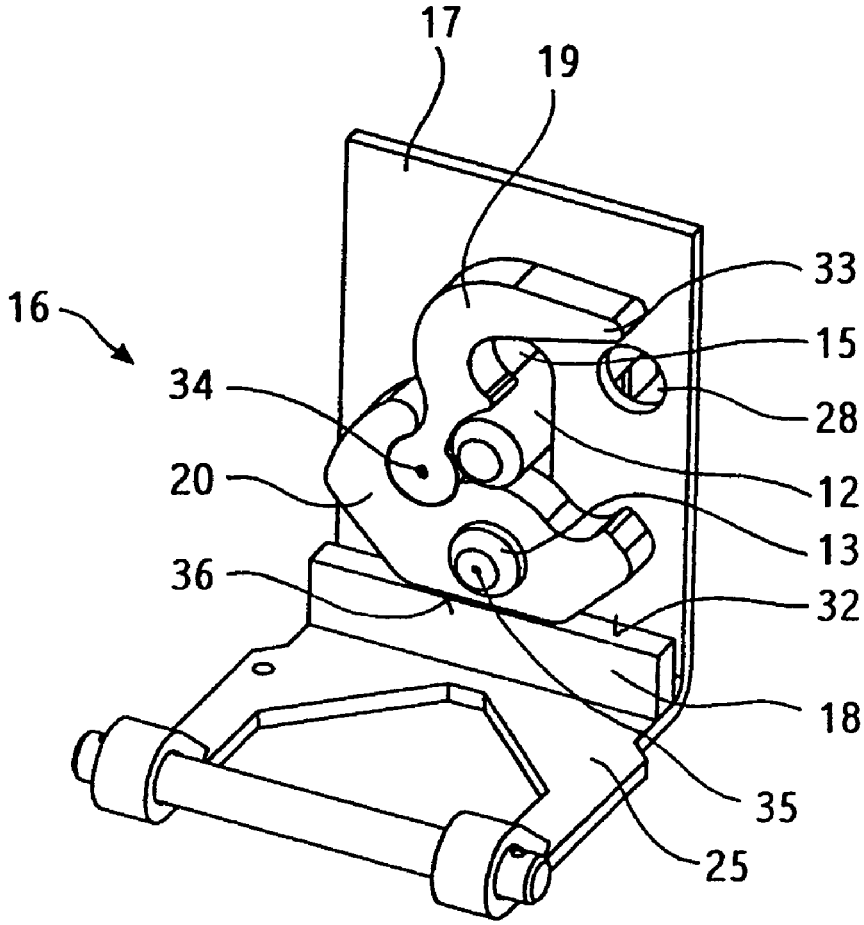
FIG. 4 shows a view of the locking mechanism of FIG. 3 in a second position.

FIG. 4 shows the locking mechanism 16 of the inventive lowering device in an open second position. In the second position of FIG. 4, the bolts 12, 13 are moved downwards in the longitudinal hole 15 and the plate 17 is stationary. The first latch part 19 is pivoted in a counter clockwise direction about the axis of rotation 34 via the free end 33 e.g. by pushing a rod from behind through the plate 17 into the opening 28, thereby triggering a turning motion of the second latch part 20 in a clockwise direction such that a second support surface 36 of the second latch part 20 abuts the support surface 32. During this rotation about the axis 35, the bolt 13, which is rotatably disposed in the second latch part 20, as well as the bolt 12 are lowered. The axis of rotation 34 is lifted during this motion sequence. In the second position, the free end 33 of the first latch part 19 frees the opening 28. When the bolts 12, 13 move into the position shown in FIG. 4, a support structure connected to the bolts 12, 13 is also lowered with the plate 17 remaining stationary.

FIG. 4 also shows how the receptacle 25 may be formed on the plate 17. The projection 18 is mounted or formed in the angled region of the plate 17 facing the receptacle 25. The size of the latch parts 19, 20 and the height of the projection 18 are adjusted such that the locking mechanism 16 can assume the second position on the plate 17 shown in this figure as well as the first position shown in FIG. 3.

Figure 5:
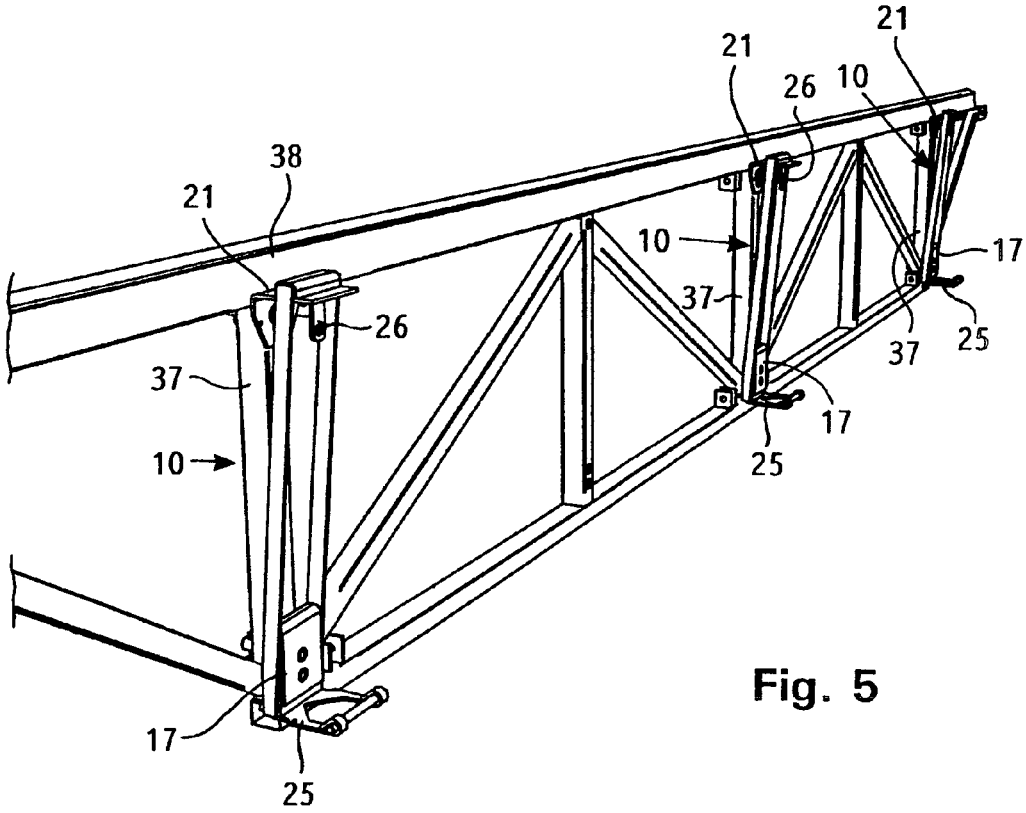
FIG. 5 shows inventive lowering devices which can be mounted to a truss girder.

FIG. 5 shows three lowering devices 10 which can be mounted e.g. on a support structure such as a truss girder. Three lowering devices 10 are mounted to vertical struts 37 of a truss girder 38 by securely mounting the brackets 21, at one end of the respective lowering device 10, and the plates 17, at the other end of the respective lowering device 10, to the truss girders 38 using bolts. The bolts connecting the support structure to the lowering device 10 are guided in elongated holes of the lowering devices 10 in such a manner that they can be moved to different positions depending on the position of the locking mechanism formed in the lowering devices 10. Construction supports of any outer shape can be inserted into the receptacles 25, 26. The receptacles 25, 26 are designed in dependence on the outer shape and the properties of the respective construction supports.

Figure 6:
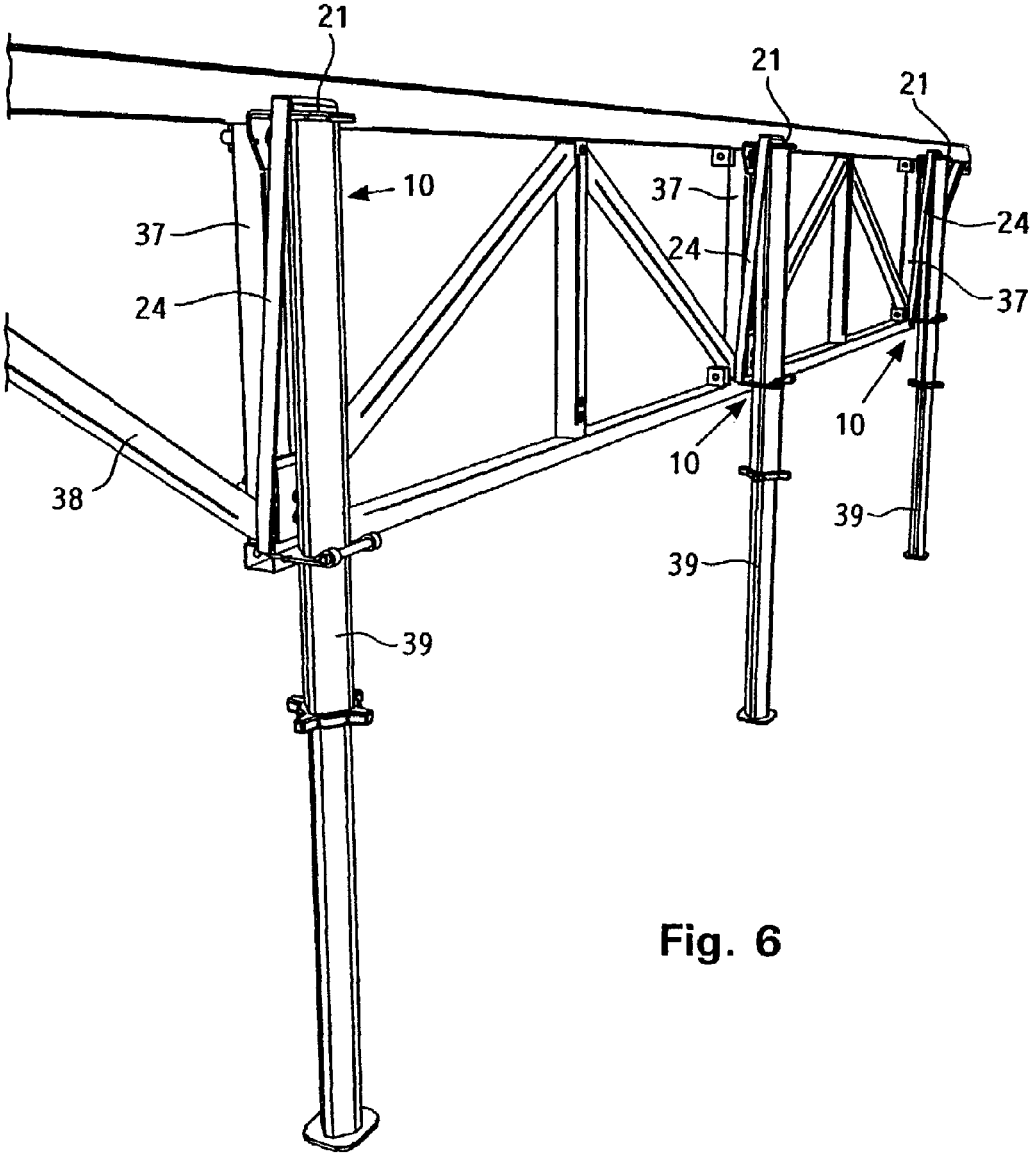
FIG. 6 shows inventive lowering devices with construction supports which are held in the lowering devices to secure a support structure, e.g. a truss girder, via the lowering devices.

FIG. 6 shows three lowering devices 10 including construction supports 39 introduced into the lowering devices 10, as they are mounted to the truss girder 38. The construction supports 39 retain the support structure mounted to the lowering device 10 at a predetermined height relative to the ground on which the ends of the construction supports 39 seat. The other ends of the construction supports 39 engage the lowering device 10 and are supported on the inner side of the brackets 21. The frames 24 of the lowering devices 10 which connect the brackets 21 to the lower mounting points of the lowering device 10 are designed to hold a support structure, such as the truss girder shown in the figure, in a torsion-proof and bending-resistant fashion. If the construction supports 39 are aligned at a certain level and fixed to the lowering devices 10, the locking mechanisms formed in the lowering devices 10 can lower the support structure mounted to the lowering devices 10 by moving the locking mechanisms 16 from the first position into the second position. If the support structure is e.g. lifted via aids such as a crane, the locking mechanisms 16 of the individual lowering devices 10 automatically move back into the first position. The latch parts of the locking mechanisms 16 are designed such that they always automatically pivot or turn into the first location when the load is removed.

A lowering device 10 of a support structure for the construction industry comprises at least one plate 17 which holds a locking mechanism 16 and either blocks the motion of the bolts 12, 13 or releases that blockage. The bolts 12, 13 are rigidly connected to a support structure and are also held in the locking mechanism 16 in a controlled manner, such that the support structure connected to the lowering device 10 is lifted in a first position and the support structure connected to the locking mechanism is lowered in the second position thereof to the extent permitted by the locking mechanism.

I claim:

1. A lowering device of a support structure, the device comprising:

a plate having an opening, a vertically extending elongated hole, and a lower projection;

a first bolt having a first end penetrating through said elongated hole and a second end mounted to the support structure;

a second bolt having a first end penetrating through said elongated hole and a second end mounted to the support structure;

a first latch part disposed at said plate to surround said first end of said first bolt; and a second latch part disposed at said plate to partially surround said first end of said second bolt, wherein said first and said second latch parts cooperate to form a locking mechanism which maintains the support structure in a first elevated position and, in response to a force of gravity, lowers the support structure into a second, lowered position, said first and said second bolts being raised within said elongated hole in said first position and being lowered within said elongated hole in said second position.

2. The lowering device of claim 1, wherein said second latch part is rotatably disposed about said second bolt and comprises a first support surface on which said second latch part is supported on said projection of said plate in said first position as well as a second support surface on which said second latch part is supported on said lower projection of said plate in said second position, wherein said first and said second support surfaces have different separations from an axis of said second bolt.

3. The lowering device of claim 2, wherein said first latch pait comprises a free end which partially covers said opening of said plate and which extends about said first bolt in such a manner that, upon pivoting said first latch part away from said opening, said second latch part automatically pivots into said second position under the action of gravitational force exerted by the support structure on said locking mechanism.

4. The lowering device of claim 1, further comprising an elongated housing, wherein said plate is mounted to a first end of said elongated housing, a second end of said elongated housing comprising a bracket having a further elongated hole for receiving a third bolt mounted to the support structure, said housing also comprising a frame which is rigidly connected to both said bracket and said plate.

5. The lowering device of claim 4, further comprising receptacles disposed on said housing for fixing said housing to the support structure.

6. The towering deviceof claim 4, wherein said housing is structured and dimensioned for mounting to a side of a floor table truss girder.

* * * * *